United States Patent [19]

Renaut

[11] 4,226,594

[45] Oct. 7, 1980

[54] METHOD FOR THE HEAT-TRANSFER PRINTING OF A TEXTILE MATERIAL

[75] Inventor: Henry Renaut, Roubaix, France

[73] Assignee: Societe Anonyme dite: Anciens Ets P. Lemaire & Cie, Roubaix, France

[21] Appl. No.: 911,139

[22] Filed: May 31, 1978

[51] Int. Cl.[2] ..... D06B 1/10; B41M 5/26

[52] U.S. Cl. ..... 8/471; 101/470; 156/84; 156/238; 156/240

[58] Field of Search ..... 28/218; 101/470; 68/5 D; 156/84, 234, 238, 240; 8/2.5 A

*Primary Examiner*—Clyde I. Coughenour
*Attorney, Agent, or Firm*—Robert E. Burns; Emmanuel J. Lobato; Bruce L. Adams

[57] ABSTRACT

The invention relates to a method for the heat-transfer printing of a longitudinal textile material.

The method consists of bringing into contact one side of the textile material and one side of a longitudinal inert carrier for dyes which can be sublimed, defining a motif thereon and of causing the sublimation of the dyes by heating and their transfer from the carrier to the textile material. It is characterized in that the carrier is formed by transversely juxtaposing a plurality of longitudinal belts with a mutual lateral overlap of two adjacent belts transversely staggering the motifs comprised by these two belts by a value corresponding to half the sum of the shrinkage respectively undergone by both the belts over their width owing to said heating, in order that the motifs comprised by these two belts overlap exactly under the heating conditions.

9 Claims, 4 Drawing Figures

METHOD FOR THE HEAT-TRANSFER PRINTING OF A TEXTILE MATERIAL

FIELD OF INVENTION

The present invention relates to a method for the heat-transfer printing of a textile material.

BACKGROUND OF THE INVENTION

It is known that the heat-transfer printing method consists of bringing into contact one side of the textile material and one side of an inert support for carrying dyes which can be sublimed, then of causing the sublimation of the dyes and their transfer from the support to the textile material, then finally of separating the textile material from the support.

The invention relates more particularly to the continuous treatment of a textile material of great length, where one brings about joint longitudinal travel of the textile material and of the dye carrier, which is also provided in a great length. The sublimation of the dyes and their transfer are ensured by a device such as a heated roller located in the usual path of the material to be dyed and of the dye carrier and bringing about continuous transfer.

This method is widely known and is completely satisfactory both when dying synthetic fibres as well as when dying natural fibres, on condition that certain modifications are made to its method of implementation and in the nature of the dyes used.

However, difficulties are encountered in carrying out this method as soon as one wishes to apply the latter to textile materials which are wider than the standard width of commercially available inert carrier belts for the dyes. This is the case for example when one wishes to print by the heat-transfer method, materials such as carpets, wall paper, cloth, wall coverings or floor coverings having a width of 4 or 5 meters for example, using inert carrier belts for dyes having a standard width of 1.60 meters.

In this case, certain users have taken measures to supply the device carrying out the heat-transfer printing proper and for example the heated roller simultaneously with a plurality of longitudinal belts carrying dyes, which are unwound side-by-side.

This method may be satisfactory when it is not absolutely necessary for the motifs printed by the various adjacent belts to join exactly, i.e. as long as one is not printing a motif whose coloured parts must have a continuous appearance over the width of the textile material. This is so for example when printing a motif formed by a bed of flowers on a light background or by garlands arranged over the length of the material.

On the other hand, when the coloured parts of the motifs must join laterally and for example when printing a motif whose background is coloured or a motif having garlands arranged over the width of the textile material, this method is not satisfactory owing to the unaesthetic appearance caused by an even slight displacement between the various belts of the inert carrier for the dyes.

In fact, if it is within the ability of a man skilled in the art to adjust the displacement of the various adjacent belts such that the motifs defined by the dyes which can be sublimed are in an identical longitudinal position when brought into contact with the textile material for the purpose of heat-transfer printing, perfect transverse juxtaposition of the various belts as they travel is particularly difficult to achieve.

One finds either a transverse separation of the belts with the appearance of longitudinal "blanks" on the material printed by the heat-transfer method, or on the contrary mutual overlapping of adjacent belts, with the appearance on the printed material of darker longitudinal strips owing to the excess amount of dye in the overlapping region, adjoining longitudinal lines where the motif has a blurred appearance, the dyes carried by the edge of one belt from which the textile material is separated by the edge of another belt tending to spread laterally.

SUMMARY OF THE INVENTION

In view of the fact that experience shows that the longitudinal "blanks" appear as soon as the spacing between two adjacent dye carrier belts exceeds two tenths of a millimeter, which appears difficult to avoid when attempting to keep the belts edge-to-edge and in order to make it possible to apply the method of heat-transfer printing to very wide textile materials using inert dye carrier belts of lesser width, the invention proposes to establish between adjacent belts, an overlap having a perfectly predetermined value and which is constantly controlled such that the darker strip effect in the areas of mutual overlap or the blurred strip effect in the immediate vicinity of these areas do not appear and naturally such that there is a perfect connection, in particular laterally, between the motifs printed on the textile material by various adjacent belts.

This latter necessity requires that the overlap, as it is established outside the operating conditions for the transfer of the dyes, i.e. outside the conditions as regards temperature and tension of the belts prevailing at the time of this transfer, takes into account the lateral shrinkage to which these belts are subjected when they are heated and placed under tension at the time of the transfer operation.

By way of example, the thermal shrinkage undergone by a paper belt having a width of 1.60 meters forming the inert carrier for the dyes which can be sublimed is of the order of 4 mm at 200° C., which is the sublimation temperature and the temperature for the transfer of the dyes, and the longitudinal tension imposed on this belt under the transfer conditions causes a decrease of its width of the order of 1.6 mm.

Consequently, before modifying or after modifying the travel of the belts unwound separately to order to bring the motifs defined thereon by the dyes which can be sublimed, into an identical longitudinal position, the invention provides establishing a mutual lateral overlap of the belts taking into account the thermal and physical shrinkage to which the latter are subsequently subjected as they pass through the station for the transfer of the dyes and preferably imposing a mutual lateral overlap on the belts over a perfectly predetermined width in the region of this transfer station.

Experience shows that the width of this mutual lateral overlap of the belts in the region of the transfer station should preferably be comprised between 0.5 and 2 mm, a lesser width of overlap possibly giving rise to irregular printing in the region of the connection, in the frequent case where the edges of the inert carrier have variations of colouration and a greater value giving rise to the appearance of the above-mentioned darker strip.

With constant operating conditions for the transfer, the overlap established outside these operating conditions should be kept as constant as possible in order that the overlap resulting under the operating conditions of the transfer is kept constantly at the required predetermined value.

The method for the heat-transfer printing of a longitudinal textile material according to the invention, consisting of bringing into contact one side of the textile material and one side of a longitudinal inert carrier for dyes which can be sublimed, defining a motif thereon, the said carrier being formed by the transverse juxtaposition of a plurality of longitudinal belts comprising motifs to be connected laterally in order to define a continuous motif over the width of the carrier, of bringing about joint longitudinal travel of the textile material and the carrier, of causing the sublimation of the dyes by heating and their transfer from the carrier to the textile material and of separating the textile material from the carrier, is consequently characterised in that in order to achieve the transverse juxtaposition of the belts prior to bringing them into contact with the textile material to be printed by the heat-transfer method, they are juxtaposed transversely with a mutual lateral overlap of two adjacent belts staggering the motifs comprised by these two belts transversely by a value corresponding to half the sum of the shrinkage respectively undergone by both of the latter over their width owing to said heating, in order that the motifs comprised by these two belts join exactly under the heating conditions.

BRIEF DESCRIPTION OF THE DRAWING

The invention will be better understood by referring to the ensuing description relating to a non-limiting method of implementation as well as to the accompanying drawings which form an integral part of this description.

Figure 2:
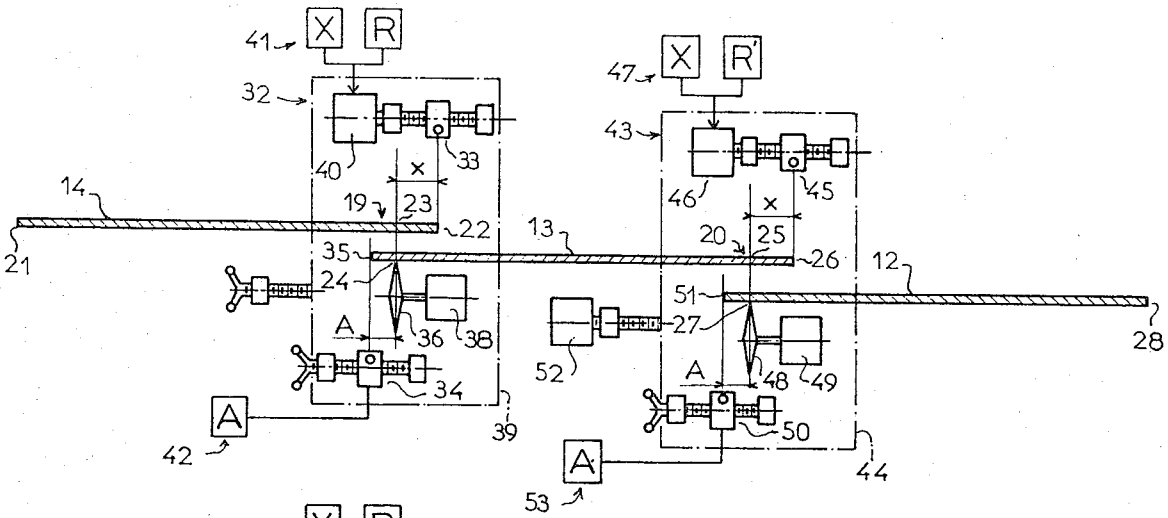
FIG. 2 illustrates in section through the plane II—II of FIG. 1, the position which three adjacent belts would occupy after a first stage of adjustment of their relative transverse positions if only this phase were carried out.
Figure 3:
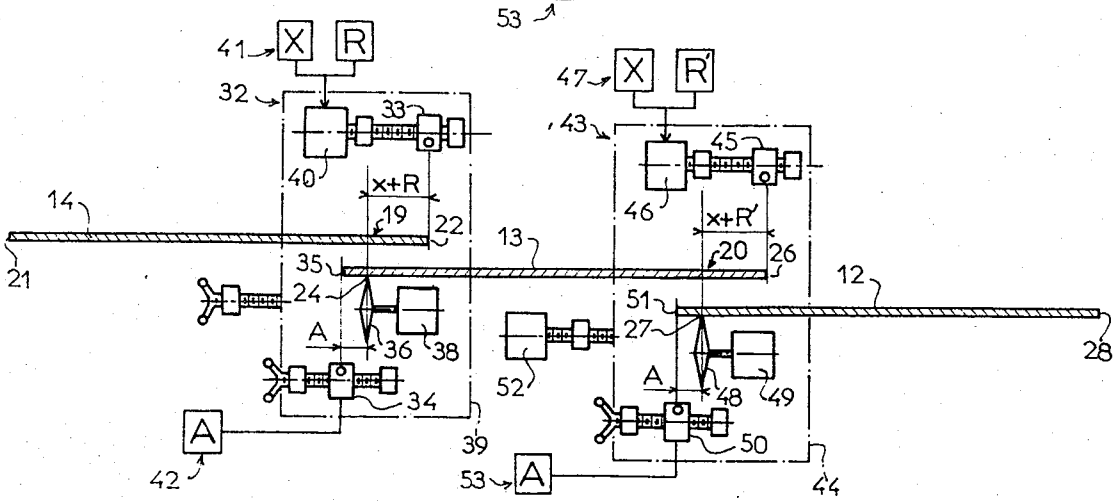
FIG. 3 is a similar view showing the relative position of the three belts after the completion of the first and second stages of adjustment, before introduction into the calender, i.e. before the belts undergo shrinkage of their width subsequent to the application of the transfer operating conditions as regards temperature and longitudinal traction applied to the belts.

The two stages of adjustment illustrated respectively in FIGS. 2 and 3 could be carried out in succession, but they are preferably carried out in a single operation.

DESCRIPTION OF PREFERRED EMBODIMENT

Figure 1:
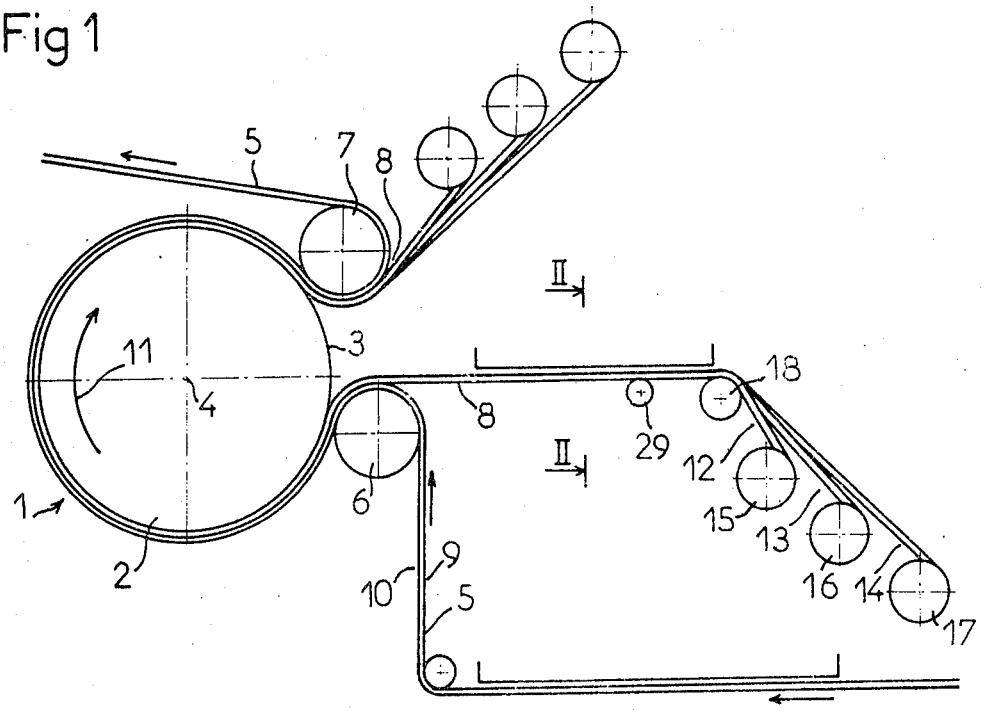
FIG. 1 is a diagrammatic side view of a heat-transfer printing calender carrying out the invention.

FIG. 1 illustrates an example where the operation of heat-transfer printing proper is carried out in a calender 1, comprising a heated drum 2 having a cylindrical periphery 3 of revolution about its axis 4 which is generally horizontal, about which it is mounted to rotate generally freely.

The calender used may be of the traditional type comprising an endless belt or "cloth" held taut against the periphery 3 of the drum, or may even be devoid of a cloth as illustrated, according to the technique described in the Applicant's French Pat. No. 75/20700.

According to this technique, the textile material 5 to be dyed, for example a carpet, is itself placed in a taut condition on the cylindrical periphery 3 of the drum, with the interposition of the inert carrier for dyes 8 between its side 9 facing the periphery 3 of the drum and the latter.

To this end, two rollers 6 and 7 are provided, whose axes are parallel to the axis 4 and which are arranged in contact with the second side 10 of the textile material 5, respectively upstream and downstream of the drum 2 taking into account the direction of rotation as shown by the arrow 11 which the roller 7, rotated about its axis by any known means, imparts to the drum 2, through the intermediary of the textile material 5 and the carrier 8 for the dyes.

Braking applied to the roller 6, which is transmitted by friction to the side 10 of the textile material 5, ensures longitudinal tensioning of the textile material 5 and of the carrier 8 for the dyes in their areas of contact with the periphery 3 of the drum and also the application of a predetermined pressure by the textile material 5 on the carrier 8 for the dye.

Downstream of the roller 7, at the outlet of the machine, the material 5 which has been printed by the heat-transfer method and the carrier 8 which has served for printing are separated and guided separately for example to winding devices.

Since the textile material 5 to be printed according to the heat-transfer method has according to the invention a transverse dimension, i.e. a width measured for example parallel to the axis 4, greater than that of the available belts for carrying dyes which can be sublimed, the inert longitudinal carrier 8 is formed by the transverse juxtaposition of such longitudinal belts, in this case three in number, bearing the reference numerals 12, 13 and 14, for example unwound from rollers 15, 16 and 17 respectively, whose respective axes are parallel to the axis 4. The carrier belts are of heat shrinkable material, e.g. paper.

Naturally, although the invention is described with reference to an example where the carrier 8 is formed from three belts 12 to 14, it is in no way limited to such a case and it is possible to juxtapose any number of belts, of generally identical but possibly different widths, required by the width of the carrier 8 to be obtained.

According to the invention, the sum of the widths of the carrier belts 12 to 14 supplying the machine is greater than the width of the carrier 8 to be formed in order to allow a slight mutual overlap of two adjacent belts, in a longitudinal area of each, located in the vicinity of its longitudinal edge adjacent another belt.

Thus, in the example illustrated, the lateral belt 14 is unwound at a higher level than that of the central belt 13, itself unwound at a higher level than that of the other lateral belt 12. A guide roller 18 whose axis is parallel to the axis 4, placed in the path of the three belts between their respective unwinding rollers 15 to 17 and the inlet roller 6 in this case in contact with the side of the three belts directed downwards, makes it possible to combine the three belts in a substantially coplanar manner, with the desired mutual lateral overlap, in order to define the single carrier 8.

According to the invention, the mutual lateral overlap of the belts forming the carrier 8 as is provided before the introduction into the heating zone between the material 5 and the periphery 3 of the heated drum 2, in the region of the inlet roller 6 of the calender, has a value which is perfectly predetermined and controlled constantly during the travel of the belts.

The mutual lateral overlap established in this way between two adjacent belts, immediately before entering the heating zone of the calender, is chosen such that under the operating conditions of the transfer, two belts overlap over a perfectly predetermined width x with perfect superimposition, in the area of the overlap, of the designs defined on the surface of these belts by the dyes which can be sublimed. This overlap under the operating conditions of the transfer is shown diagrammatically in the upper part of FIG. 4.

The value of x is preferably chosen between 0.5 and 2 mm.

Figure 4:
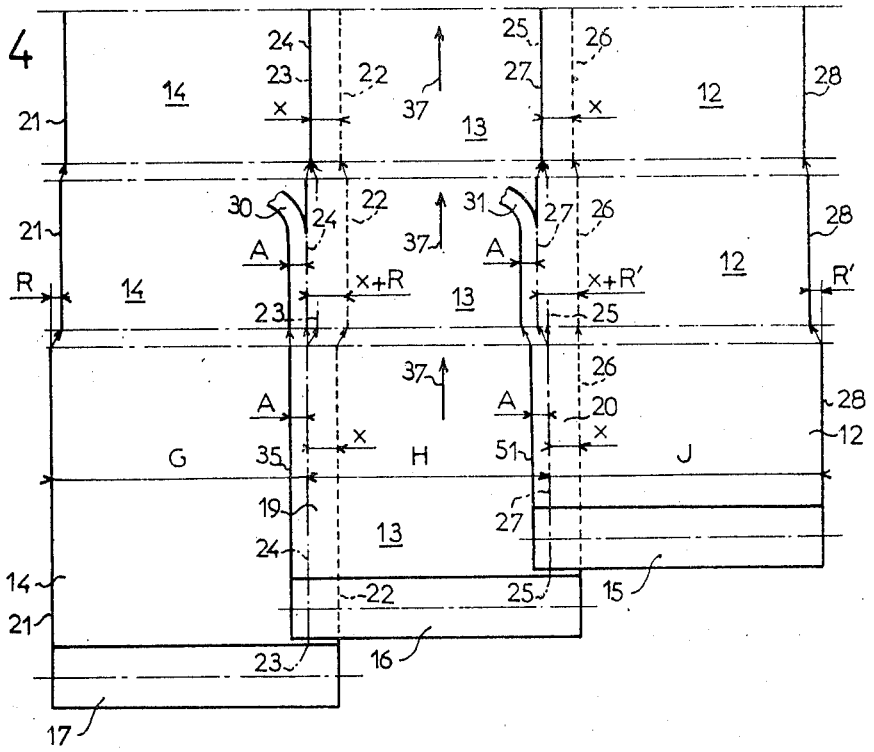
FIG. 4 shows, in an underneath view with reference to FIGS. 2 and 3, the relative positions of the belts in the case of FIG. 2, in the case of FIG. 3 and inside the calender, under the operating conditions for the transfer.

To this end, as shown in the lower part of FIG. 4 and FIG. 2, one begins by establishing between two adjacent belts, an overlap whose width is greater than x to compensate for shrinkage of the belts, and such that the motifs comprised by the two belts in question are superimposed exactly in the overlapping region, respectively 19 in the case of the belts 13 and 14 and 20 in the case of the belts 12 and 13 (lower part of FIG. 4).

If we consider in more detail the overlap region 19 of the belts 14 and 13, the width of this belt is increased by a value R, taking into account the shrinkage which these belts will undergo over their width when they are under the operating conditions of the transfer, i.e. after thermal shrinkage and in the case of the example illustrated, shrinkage resulting from their tensioning in the longitudinal direction. Establishing this additional overlap is illustrated in the central part of FIG. 4.

The additional overlap R is established in the following manner $$R = \frac{G + H}{2} \times C, \text{ in which}$$

G designates the total width of the belt 14 less the value x, i.e. the transverse distance separating from the longitudinal edge 21 of the belt 14 opposite the edge 22 of the latter, superimposed on the central belt 13, a longitudinal line 23 at a distance from this edge 22 equal to x;

H designates the transverse distance separating the longitudinal lines 24 and 25 of the central belt 13; the line 24 is the line of the belt 13 coinciding with the line 23 of the belt 14 when the first overlap is established between these belts, which overlap has a width greater than x and such that the motifs comprised by the two belts 13 and 14 are superimposed exactly in the overlap region 19. 25 is the longitudinal line of the belt 13 at a distance equal to x from the longitudinal edge 26 of the latter furthest from the line 24;

C is a coefficient of shrinkage of the carrier material which can be easily determined by a man skilled in the art preferably in order to take into account both thermal shrinkage and physical shrinkage of the belt as it passes under the operating conditions of the transfer.

Likewise, after having established between the belts 12 and 13 an overlap greater than x and such that the motifs comprised by these two belts are superimposed exactly in the overlap region 20, as shown diagrammatically by the lower part of FIG. 4, the width of this overlap is increased by a value R′ established in the following manner:

$$R' = \frac{H + J}{2} \times C, \text{ in which}$$

J designates the distance separating the line 27 of the belt 12 coinciding with the line 25 of the belt 13 when the first overlap whose width is greater than x is established and the longitudinal edge 28 of the belt 12 furthest from this line 27.

Then, whilst keeping the three belts in the relative position established in this way, the borders of the belts are cut in the overlap regions 19 and 20 in order to give the width of the latter exactly a value equal respectively to x+R and to x+R′ (central part of FIG. 4).

This operation is preferably carried out by cutting the border of whichever of the two overlapping belts is superimposed on the side of the other belt comprising the dyes.

In the example illustrated where the dyes are carried by the lower side of the belts, in the region of the device 29, one thus detaches the border 30 of the central belt 13 superimposed on the belt 12 and the border 31 of the belt 12 superimposed on the belt 13.

The arrangement of the three belts thus superimposed respectively over a width x+R and over a width x+R′ is thus introduced into the heating zone of the calender 1 jointly with the material 5 to be printed by the heat-transfer method and, under the operating conditions of the transfer process, undergoes its shrinkage which restores the mutual overlap of adjacent belts to the value x by re-establishing exact superimposition of the motifs comprised by the various belts in their respective overlap regions (upper part of FIG. 4).

The coincidence in the longitudinal direction between the motifs comprised by the various belts may be ensured at any point located between their respective unwinding roller 15 to 17 and the roller 6. For this purpose, it is possible to use reference marks provided periodically on the border of the inert carrier belts for dyes normally used in heat-transfer printing, which can be read by any device such as a photo-electric cell reading and memorizing the relative longitudinal positions of the reference marks comprised by the various belts possibly in order to act on the speed of longitudinal travel of either of these belts if the relative positions read should vary with respect to the relative positions memorised, corresponding to perfect coincidence of the motifs in the longitudinal direction.

These means for controlling the travel of each belt may intervene either separately in the region of each unwinding roller 15, 16, 17, for example by braking one of these unwinding rollers if the corresponding belt has a lead with respect to the adjacent belts taking into account the direction of travel, or by the play of any individual drive device for each belt between the unwinding rollers and the inlet roller 6 of the calender.

Advantageously, it is possible to provide in the path of the belts, devices analysing the tension of the latter, such that one belt is always at the minimum longitudinal tension admissible for correct operation of the calender. The construction of such a device is within the ability of a man skilled in the art.

The relative transverse position of the various belts is also constantly controlled and corrected in order to obtain the desired overlap at any instant, by means of devices such as those shown diagrammatically by way of example in FIGS. 2 and 3.

These devices control the transverse position of the borders of the various belts in the region of overlap of the latter. These devices also ensure cutting of the borders 30 and 31 corresponding to the excess overlap.

With particular reference to the overlap region 19, located in the immediate vicinity of the latter is a so-called "cutting" arrangement 32 comprising a photo-electric cell 33 able to be located directly above the longitudinal edge 22 of the upper belt 14, a photo-electric cell 34 able to be located directly above the longitudinal edge 35 of the central belt 13 located below the side belt 14 and a knife 36 of any known type, for example mounted to rotate about a transverse axis with respect to the general direction 37 of movement of the belts, under the action of a motor 38, in order to detach the border 30.

The entire cutting arrangement 32 is supported by a carriage shown diagrammatically by the dot-dash line 39, whose position can be adjusted manually in a transverse direction parallel to the general plane of the belts. The position of the cell 34 with respect to the carriage 39 in this same direction can be adjusted manually, the position of the cell 33 with respect to the carriage 39 in this same direction being adjustable automatically under the action of a motor 40 which maintains a constant predetermined transverse spacing between the cutting line of the knife 36 and the edge 22 of the belt 14, thus keeping the mutual overlap of the belts 14 and 13 at the predetermined value x+R on entering the calender. The motor 40 is controlled by any appropriate device 41 allowing adjustment and the display of R and X, preferably separately.

The width A of the cut border 30 is preferably also displayed by a device 42 connected to the means for adjusting the transverse position of the cell 34.

Provided in the vicinity of the overlap region 20 of the belts 12 and 13 is an identical so-called "cutting" device 43, comprising a carriage 44 whose position can be adjusted in a transverse direction parallel to the general plane of the belts. Opposite the edge 26 of the central belt 13, this carriage 44 comprises a photo-electric cell 45 whose transverse position on the carriage is adjusted automatically, at each instant, by a device 47 identical to the device 41 and facilitating the adjustment and display of x and R', in order to keep at a distance x+R' from the edge 26, the cutting line of a knife 48 carried by the carriage 44 opposite the lower side of the side belt 12, which knife is for example a disc rotated by a motor 49 about its axis, arranged transversely and parallel to the general plane of the belts. Apart from the cell 45 and the knife 48, the carriage 44 comprises a cell 50 whose transverse position with respect to the carriage can be adjusted manually, in order to be located opposite the longitudinal edge 51 of the side belt 12 opposite the edge 28 of the latter, in order to establish the width A' of the border 31.

Furthermore, the cells 33, 34, 45, 50 are connected to means making it possible to move the belts laterally.

Thus, if we consider the cutting arrangement 32, a lateral movement of the belt 13 detected by the cell 34 controls the return movement of the belt 13, and, if the belt 14 moves laterally, the cell 33 causes its return movement.

On the other hand, if the belt 13 moves laterally, the cell 45 controls a motor 52 acting on the position of the carriage 44 in the transverse direction parallel to the general plane of the belts and consequently, the cell 50 causes the lateral movement of the belt 12 to re-establish the belts 12 and 13 in their relative position.

Similarly, if the side belt 12 only moves laterally, the cell 50 controls its return movement.

The adjustment of the relative transverse positions of the belts by means of such a device is as follows for example.

After having displayed a zero value of R and R' on the display devices 41 and 47, the adjustment of the cutting arrangement 32 is undertaken by adjusting x to the minimum distance facilitating correct printing then, after having superimposed the motifs of the two belts 14 and 13 perfectly in their overlap region 19, the cell 34 is brought opposite the edge 35 of the belt 13.

One then transfers the same values of x and of the width A of the border to be eliminated to the cutting group 43, 47 respectively and to a device 53 for adjusting and displaying the relative transverse position of the cell 50 and of the knife 48. One then checks that the motifs comprised by the belts 12 and 13 in their overlap region 20 coincide perfectly.

R and R' are then calculated and this corrective is displayed at 41 and 47. These devices 41 and 47 will automatically increase on the machine, the distance x of the width R or R' respectively, such that after eliminating the borders 30 and 31 by the knives 36 and 48, the belts 13 and 14 are superimposed over a width x+R and the belts 12 and 13 over a width x+R' at the time of coming into contact with the material 5 and of being subjected to the operating conditions of the transfer, in the vicinity of the drum 2.

Naturally, these arrangements are described solely as a non-limiting example and the method according to the invention could be carried out in a different manner without diverging from the framework of the latter.

Preferably, as shown in FIG. 1, on leaving the calender, winding of the various inert carrier belts for dye which have served for heat-transfer printing is ensured about different parallel axes in order to eliminate abnormal tension due to overlapping of the belts.

What is claimed is:

1. In a method of continuous heat-transfer printing of longitudinal textile material which comprises superposing on one side of said textile material a plurality of transversely juxtaposed longitudinal belts of inert heat-shrinkable carrier material having thereon sublimable dyes which define a motif, and passing said textile material with said belts thereon continuously through a heating zone to cause sublimation of said dyes and their transfer from said carrier material to said textile material, the improvement which comprises laterally positioning said belts of carrier material in advance of said heating zone with contiguous edges of said belts overlapping one another by an amount equal to one-half the amount of shrinkage which each of said belts undergoes over its width owing to the heating of said belts in said heating zone, whereby upon passage of said textile material and carrier belts through said heating zone, said belts shrink laterally so that edges of adjacent belts abut and the motifs carried by said belts precisely join to form a continuous motif extending across the width of said textile material.

2. A method according to claim 1, wherein said carrier belts in said heating zone are subjected to tension producing lateral shrinkage in addition to shrinkage caused by heating, and wherein said belts in advance of said heating zone are positioned with contiguous edges overlapping one another by an amount equal to one-half the amount of shrinkage which each of said belts undergoes in said heating zone by virtue of said heating and said tension.

3. A method according to claim 1 or claim 8, wherein at least one of said carrier belts initially has a width greater than that required to provide said overlap, and in which said belt is continuously trimmed by removing an edge portion of said belt in advance of said heating zone to provide said overlap of the carrier belts.

4. A method according to claim 1, wherein one or another of said carrier strips is selectively braked in advance of said heating zone to attain longitudinal registration of said motifs on said several belts.

5. In a method of continuous heat-transfer printing of longitudinal textile material which comprises superposing on one side of said textile material a plurality of transversely juxtaposed longitudinal belts of inert heat-shrinkable carrier material having thereon sublimable dyes which define a motif, and passing said textile material with said belts thereon continuously through a heating zone to cause sublimation of said dyes and their transfer from said carrier material to said textile material, the improvement which comprises laterally positioning said belts of carrier material in advance of said heating zone with contiguous edges of said belts overlapping one another by an amount equal to one-half the amount of shrinkage which each of said belts undergoes over its width owing to the heating of said belts in said heating zone and by an additional amount equal to a predetermined final overlap of said belts desired in said heating zone, whereby upon passage of said textile material and carrier belts through said heating zone, said belts shrink laterally so that they overlap only by the amount of said predetermined final overlap to form a continuous motif extending across the width of said textile material.

6. A method according to claim 5, wherein said carrier belts are so positioned in advance of the heating zone that said final overlap in the heating zone after shrinkage of said belts is between 0.5 and 2 mm.

7. A method according to claim 5, wherein said carrier belts in said heating zone are subjected to tension producing lateral shrinkage in addition to shrinkage caused by heating and wherein said belts in advance of said heating zone are positioned with contiguous edges overlapping by an amount equal to the sum of said predetermined final overlap, and one-half the amount of shrinkage which each of said belts undergoes in said heating zone by virtue of said heating and said tension.

8. A method according to claim 5 or claim 7, wherein at least one of said carrier belts initially has a width greater than that required to provide said overlap, and in which said belt is continuously trimmed by removing an edge portion of said belt in advance of said heating zone to provide said overlap of the carrier belts.

9. A method according to claim 5, wherein one or another of said carrier strips is selectively braked in advance of said heating zone to attain longitudinal registration of said motifs on said several belts.

* * * * *